US006631789B1

(12) United States Patent
de Jong et al.

(10) Patent No.: US 6,631,789 B1
(45) Date of Patent: Oct. 14, 2003

(54) METHOD FOR BRAKING A TRACTION SHEAVE ELEVATOR, AND TRACTION SHEAVE ELEVATOR

(75) Inventors: Johannes de Jong, Kerava (FI); Esko Aulanko, Kerava (FI); Ilkka Lempiö, Kangasala (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 09/667,711

(22) Filed: Sep. 22, 2000

Related U.S. Application Data

(63) Continuation of application No. PCT/FI99/00231, filed on May 23, 1999.

(51) Int. Cl.[7] ..... B66B 5/04

(52) U.S. Cl. ..... 187/349; 187/373; 187/287; 187/288

(58) Field of Search ..... 187/266, 288, 187/293, 373, 377, 349

(56) References Cited

U.S. PATENT DOCUMENTS

| | | | | | |
|---|---|---|---|---|---|
| 1,934,508 | A | * | 11/1933 | McCormick | 187/350 X |
| 1,977,452 | A | * | 10/1934 | Newschotz | 187/350 X |
| 1,987,719 | A | * | 1/1935 | Sprague | 187/375 |
| 4,085,823 | A | * | 4/1978 | Caputo et al. | 187/293 |
| 4,662,481 | A | * | 5/1987 | Morris et al. | 187/373 |
| 5,323,878 | A | | 6/1994 | Nakamura et al. | |
| 5,366,044 | A | | 11/1994 | Jamieson et al. | |
| 5,458,216 | A | * | 10/1995 | Tanaka et al. | 187/373 |
| 5,628,385 | A | * | 5/1997 | Yumura et al. | 187/373 |

FOREIGN PATENT DOCUMENTS

| | | |
|---|---|---|
| GB | 2212782 A | 2/1989 |
| GB | 2250012 A | 5/1992 |
| JP | 1181688 | 7/1989 |
| JP | 9221285 | 2/1996 |

* cited by examiner

*Primary Examiner*—Eileen D. Lillis
*Assistant Examiner*—Thuy V. Tran
(74) *Attorney, Agent, or Firm*—Birch, Stewart, Kolasch & Birch, LLP

(57) ABSTRACT

A method and apparatus for braking a tractor sheave elevator. In an emergency situation, the elevator braking is complimented by using a second braking device not connected to the traction sheave. A secondary braking can be accomplished by applying a braking force to the elevator ropes or guide rail. If the secondary brake is applied first, the ropes will not slip on the traction sheave when the primary brake is applied. Alternatively, slippage may be allowed to occur in order to distribute the heat produced by braking.

13 Claims, 2 Drawing Sheets

METHOD FOR BRAKING A TRACTION SHEAVE ELEVATOR, AND TRACTION SHEAVE ELEVATOR

This application is a Continuation of PCT International Application No. PCT/FI99/00231 filed on Mar. 23, 1999, which designated the U.S. and on which priority is claimed under 35 U.S.C. § 120, the entire contents of which are hereby incorporated by reference.

FIELD OF THE INVENTION

The present invention relates to a method for braking a traction sheave elevator and to a traction sheave elevator.

The present invention relates to a method for braking a traction sheave elevator and to a traction sheave elevator.

DESCRIPTION OF THE BACKGROUND ART

The machinery a traction sheave elevator includes a traction sheave with grooves in which the elevator hoisting ropes are fitted and an electric motor driving the traction sheave either directly or via a gear. The machinery comprises a brake which acts on the traction sheave either directly or e.g. via a shaft. The working principle of the operating brake of an elevator is such that the brake is forced to brake always when it has not been specifically commanded not to brake. In a typical operating brake construction, the brake is closed by the force of a spring or an equivalent element and opened and kept open by a controlled actuator counteracting the force of the closing element. When the traction sheave is braked, the braking effect is transmitted to the hoisting ropes by the agency of frictional grip and other gripping effects applied to the ropes by the traction sheave. In an emergency braking situation, when the elevator is stopped as quickly as possible, the braking system is likely to be required to provide a greater gripping force than during acceleration and deceleration in a normal operating situation.

To increase the grip between the ropes and the traction sheave, especially in fast elevators and elevators with a large hoisting height, the traction sheave is sometimes provided with grooves having a very large undercut angle. The frictional grip can also be improved by increasing the angle of contact of the rope. The solutions used to increase the contact angle include e.g. ESW (extended single wrap) and double-wrap suspension, in which a contact angle exceeding 180° between the traction sheave and the ropes is achieved by using a crosswise rope arrangement or a secondary rope pulley. In conventional single-wrap (CSW) suspension, the contact angle between the traction sheave and the ropes is 180° or somewhat less if the distance between the ropes has been increased by using a diverting pulley. In short, the friction can be increased by using undercut rope grooves and increasing the undercut angle and by increasing the angle of contact.

In a normal operating situation in most elevators, including fast elevators and those with a large hoisting height, a conventional suspension with the hoisting ropes only running over the traction sheave and a moderate undercut angle of the traction sheave grooves would be sufficient to guarantee a non-slip grip of the ropes on the traction sheave in all load situations of the elevator. However, to allow for emergency braking, the system must be designed to provide a better grip. However, improving the grip leads to drawbacks that increase elevator costs, especially costs arising during operation. Undercut rope grooves promote wear of the rope and rope groove, and the larger the undercut angle, the faster the wear. Similarly, rope bends following each other in close succession in ESW and double-wrap suspension increase rope wear. In ESW and double-wrap suspension, an oblique rope contact is an additional factor increasing rope wear. Double-wrap suspension imposes an extra load on the bearings of the traction sheave and the secondary rope pulley.

BRIEF SUMMARY OF THE INVENTION

The object of the present invention is to extend the use of the basically simple conventional elevator suspension system to faster elevators and elevators with a larger hoisting height and to improve the operating characteristics of elevators like those used at present. The invention is also applicable for the correction of the above-mentioned drawbacks.

The solution of the invention makes it possible to achieve a longer useful life of the ropes and traction sheave. The drive machinery can be implemented using a solution in which the internal stresses are small, which means e.g. a lower load on the bearings. The useful life of the ropes, traction sheave and bearings may even be increased to multiple times the original service length. In general, simpler solutions can be applied in the machinery and rope system. Since CSW suspension does not require any diverting pulley arrangements in the machine room, the floor area required by even a very large elevator is reasonable. No heavy support structures for diverting pulley arrangements are needed. The moderate size and weight of the machinery achieved by the invention allow a simpler machine room lay-out and easier installation. High-performance machines are often used in elevator groups comprising several elevators, in which case the possibility of easy placement provides a pronounced advantage i respect of space utilisation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Figure 1:
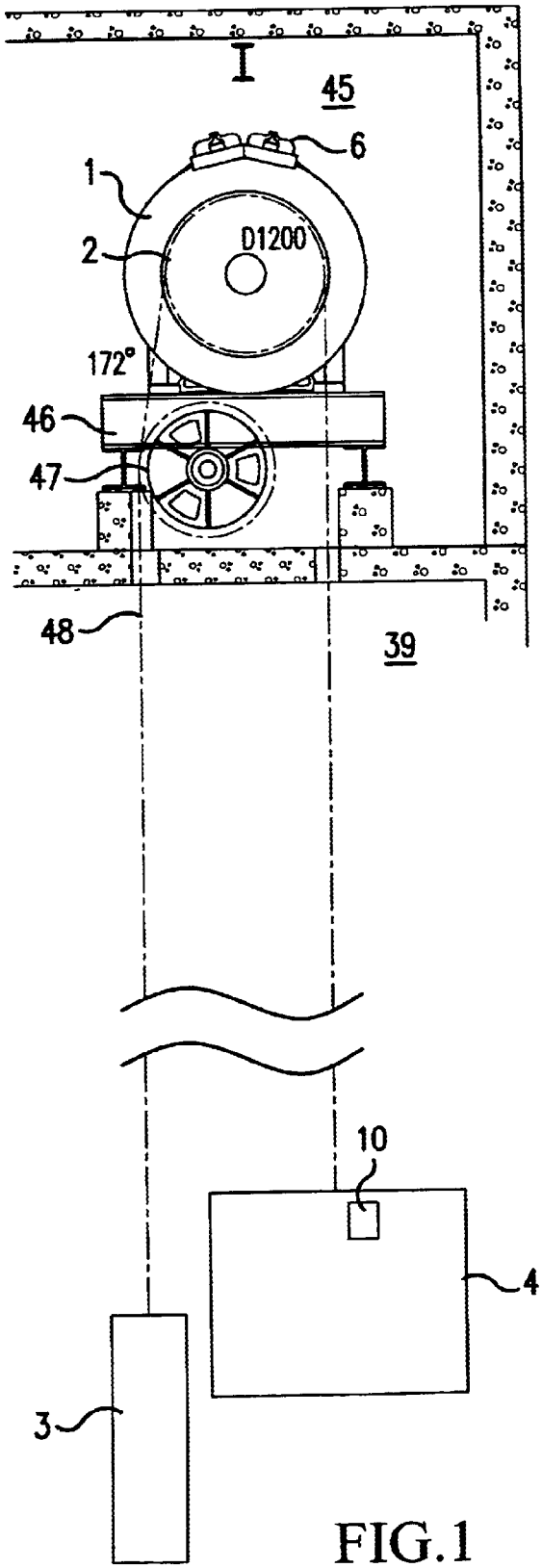
FIG. 1 illustrates the placement of a drive machine according to the invention.

FIG. 1 illustrates the placement of a drive machine 1 in a machine room 45 above an elevator shaft 39. The drive machine is placed on a platform 46 constructed of steel bars. Using a diverting pulley 47, the hoisting ropes 48 are so arranged that the distance between the rope portions going to the counterweight 3 and to the elevator car 4 is somewhat larger than the diameter of the traction sheave 2. The brake 6 of the drive machine functions primarily as aholding brake when the elevator is standing still. A preferred braking method in an elevator is electrical braking. In general, this means that the motor brakes regeneratively even during power failures and when the emergency-stop function is used. The operating brake 6 falls, leading to an increased braking effect. Therefore, a great braking force is applied to the traction sheave, whereas the ropes, counterweight and elevator car and other masses suspended on them tend to continue their movement. If the grip between the hoisting ropes and the traction sheave is insufficient, then the rope will start slipping and the elevator cannot be stopped by braking the traction sheave. In an elevator as illustrated by FIG. 1, a risk of rope slip is present at fairly high speeds or when there is a large imbalance between the car and counterweight sides of the system. However, in fast elevators with a large hoisting height, the car and counterweight are so heavy that even a 25% overload does not in itself cause rope slip. At lower speeds, if the elevator is conventionally dimensioned, the rope will not slip at sudden braking e.g. in an emergency stop situation. At higher speeds, when the speed is several meters per second, the rope is very likely to start slipping, especially if the rope groove undercut of the traction sheave has been designed with an aim to reduce rope wear.

In practice, the invention is implemented e.g. by providing the traction sheave of the drive machine with a brake, said traction sheave driving the hoisting ropes and, via the hoisting ropes, the elevator car and its counterweight. When the emergency stop function is activated, the brake falls onto the traction sheave, braking its motion. The emergency stop function is activated in a manner known in itself. Emergency stopping is complemented by using a braking device 10 not comprised in the drive machine. The braking device not comprised in the drive machine may apply a braking force to several elements of the elevator, because it is intended to produce an effect on the motion of the elevator car independently of the friction between the elevator ropes and the traction sheave. The braking device may apply a braking force e.g. to the ropes, a guide rail or a compensating device. A preferred solution is a gripper type device applying a braking force to the ropes or to a guide rail or a compensating device. The braking device not comprised in the drive machine can be caused to start braking before in this case, rope slip may be avoided altogether and braking is achieved using only the brakes. On the other hand, rope slip can be utilised in the braking. This distributes the heat produced by the braking action among several parts. By utilising rope slip, the power required of the braking device not comprised in the drive machine can be reduced.

If the brake 10 is implemented as an eddy current brake, e.g. by using permanent magnets so that the magnets are brought into interaction with the elevator guide rails, the deceleration produced by such a device is dependent on the speed. It is possible to implement a mechanical braking device which grips a guide rail or rope and which only brakes at a speed exceeding a preset speed. Thus, the braking device will not be triggered into action e.g. in an inspection drive situation where the elevator is driven at a relatively low speed even if the safety circuit is open, so the device does not require a separate safety circuit by-pass function. On the other hand, an eddy-current brake has a negligible braking power at a low speed, so such a brake does not prevent the elevator from being operated in inspection drive mode.

Figure 2:
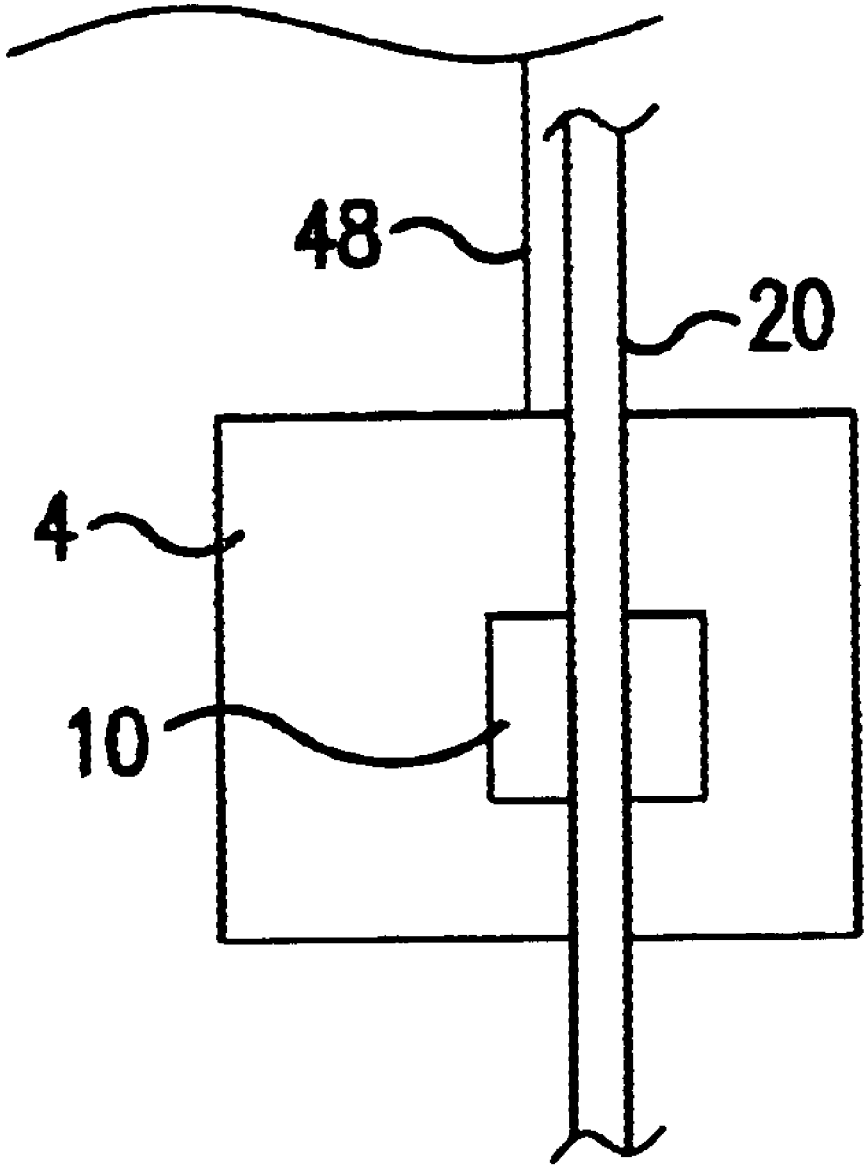
FIG. 2 illustrates the arrangement of the braking device and a guide go rail.

FIG. 2 shows in more detail part of FIG. 1, including the elevator car. The car has associated with it guide rail 20. When braking device 10 in the elevator car is actuated, braking occurs between the braking device and the guide rail. This can be accomplished by including within braking device 10 an eddy current brake. It can also be accomplished by including a gripper which grips the guide rail.

It is obvious to a person skilled in the art that different embodiments of the invention are not restricted to the examples presented above, but that they may be varied within the scope of the claims presented below.

What is claimed is:

1. A method for braking a traction sheave elevator comprising a drive machine including a traction sheave, hoisting ropes driven by the traction sheave and an elevator car and counterweight suspended on the hoisting ropes, the method comprising the steps of:

providing a first braking device adjacent the drive machine and operable on the traction sheave;

providing a second braking device separate from the first braking device, the second braking device always being out of contact with the traction sheave;

starting braking of the elevator by the second braking device during an emergency stop function; and starting braking of the elevator by the first braking device after the starting of braking by the second braking device during an emergency stop function, said second braking device being selectively closed so as to be operable as a normal brake.

2. The method as defined in claim 1, further comprising the step of providing more braking force during an emergency stop function than a normal stop function, the first and second braking devices providing braking force during the emergency stop function.

3. The method as defined in claim 1, further comprising the step of providing a braking force directly to one of the ropes, a guide rail or a compensating device of the elevator by the second braking device during an emergency stop function.

4. The method as defined in claim 1, wherein deceleration achieved by the second braking device is dependent on a speed of the elevator.

5. The method as defined in claim 1, wherein braking of the elevator by the second braking device occurs only at a speed exceeding a preset speed.

6. A traction sheave elevator comprising:

a drive machine including a traction sheave, the traction sheave having rope grooves;

hoisting ropes driven by the traction sheave, the hoisting ropes being received in the rope grooves;

an elevator car suspended on the hoisting ropes;

a first braking device operable on the traction sheave;

a second braking device separate from the first braking device, the second braking device always being out of contact with the traction sheave, said second braking device being selectively closed so as to be operable as a normal brake the second braking device braking the elevator before the first braking device brakes the elevator during an emergency stop function.

7. The traction sheave elevator as defined in claim 6, wherein the first braking device provides braking force during a normal stop operation and wherein the second braking device provides additional braking force during the emergency stop function in addition to braking force provided by the first braking device.

8. The traction sheave elevator as defined in claim 6, wherein the second braking device is a gripper which applies a braking force directly to at least one of the hoisting ropes, a guide rail and a compensating device of the elevator.

9. The traction sheave elevator as defined in claim 6, wherein the second braking device is an eddy-current brake which applies a braking force to a guide rail.

10. The traction sheave elevator as defined in claim 6, wherein the second braking device is operable to apply a braking when speed of the elevator exceeds a preset speed.

11. The traction sheave elevator as defined in claim 6, wherein braking of the elevator by the second braking device is dependent on a speed of the elevator.

12. A method for braking a traction sheave elevator comprising a drive machine including a traction sheave, hoisting ropes driven by the traction sheave and an elevator car and counterweight suspended on the hoisting ropes, the method comprising the steps of:

providing a first braking device adjacent the drive machine and operable on the traction sheave;

providing a second braking device separate from the first braking device, the second braking device always being out of contact with the traction sheave; and stopping the elevator with the second braking device while the ropes are slipping in rope grooves of the traction sheave.

13. A traction sheave elevator comprising:

a drive machine including a traction sheave, the traction sheave having rope grooves;

hoisting ropes driven by the traction sheave, the hoisting ropes being received in the rope grooves;

an elevator car suspended on the hoisting ropes;

a first braking device operable on the traction sheave;

a second braking device separate from the first braking device, the second braking device always being out of contact with the traction sheave, said second braking device being selectively closed so as to be operable as a normal brake, wherein the elevator is stopped with the second braking device while the hoisting ropes are slipping in the rope grooves of the traction sheave.

* * * * *